US005320175A

United States Patent [19]

Ritter et al.

[11] Patent Number: 5,320,175

[45] Date of Patent: Jun. 14, 1994

[54] SUBSEA WELLHEAD CONNECTIONS

[75] Inventors: Paul B. Ritter, Slidell, La.; Carl G. Langner, Spring, Tex.; William H. Petersen, Mandeville, La.; Ray R. Ayers, Houston, Tex.

[73] Assignee: Shell Oil Company, Houston, Tex.

[21] Appl. No.: 11,018

[22] Filed: Jan. 29, 1993

[51] Int. Cl.[5] ..... E21B 33/035

[52] U.S. Cl. ..... 166/339; 166/344; 166/347; 405/169

[58] Field of Search ..... 166/335, 338-341, 166/344, 345, 347; 405/169, 195.1

[56] References Cited

U.S. PATENT DOCUMENTS

| | | | |
|---|---|---|---|
| 3,336,572 | 8/1967 | Paull et al. | 166/341 X |
| 3,373,807 | 3/1968 | Fischer et al. . | |
| 3,431,739 | 3/1969 | Richardson et al. . | |
| 4,015,660 | 4/1977 | Lewis | 166/347 |
| 4,041,719 | 8/1977 | Baugh . | |
| 4,145,909 | 3/1979 | Daughtry . | |
| 4,277,202 | 7/1981 | Archambaud et al. | 166/343 X |
| 4,541,753 | 9/1985 | Langner . | |
| 4,671,702 | 6/1987 | Langner | 166/342 X |
| 4,673,041 | 6/1987 | Turner et al. | 166/344 X |
| 4,676,696 | 6/1987 | Laursen | 166/338 X |
| 4,695,189 | 9/1987 | Wallace | 166/345 X |
| 5,092,711 | 3/1992 | Langner | 166/341 X |
| 5,195,589 | 3/1993 | Mota et al. | 166/366 X |

OTHER PUBLICATIONS

Booth, Derrick, "Subsea-completed wells account for 18% of offshore production", *Offshore* (Nov. 1991).

McCabe, Charles, "Contractors apply ingenuity to field abandonment", *Ocean Industry*, (Nov. 1991).

*Primary Examiner*—Ramon S. Britts
*Assistant Examiner*—Roger J. Schoeppel
*Attorney, Agent, or Firm*—Del S. Christensen

[57] ABSTRACT

A diverless and guidelineless method to connect two subsea flowlines by a jumper assembly is provided. Pivotable stabs and fluid connection means are provided on each end of the jumper assembly. The stabs mate into receptacles located on the subsea flowline connections. The flowline is preferably lowered vertically and hinged over while sequentially landing the two pivotable stabs into their respective stab receptacles.

23 Claims, 5 Drawing Sheets 20
23
A
21
22
16
17
18
13
10
19
11
14
16
17
20
23
B
21
16
21
C
15
14

FIG. 4
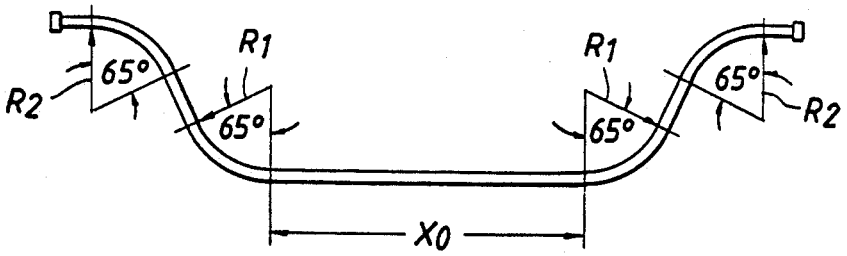
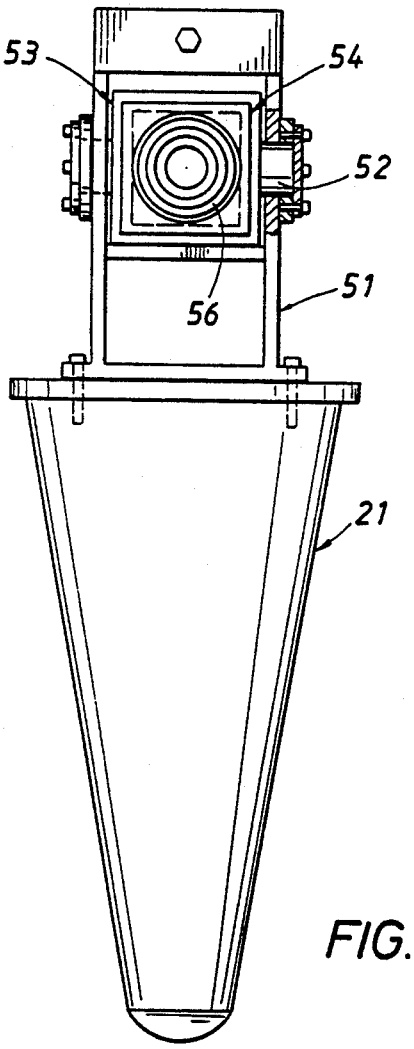
FIG. 5A
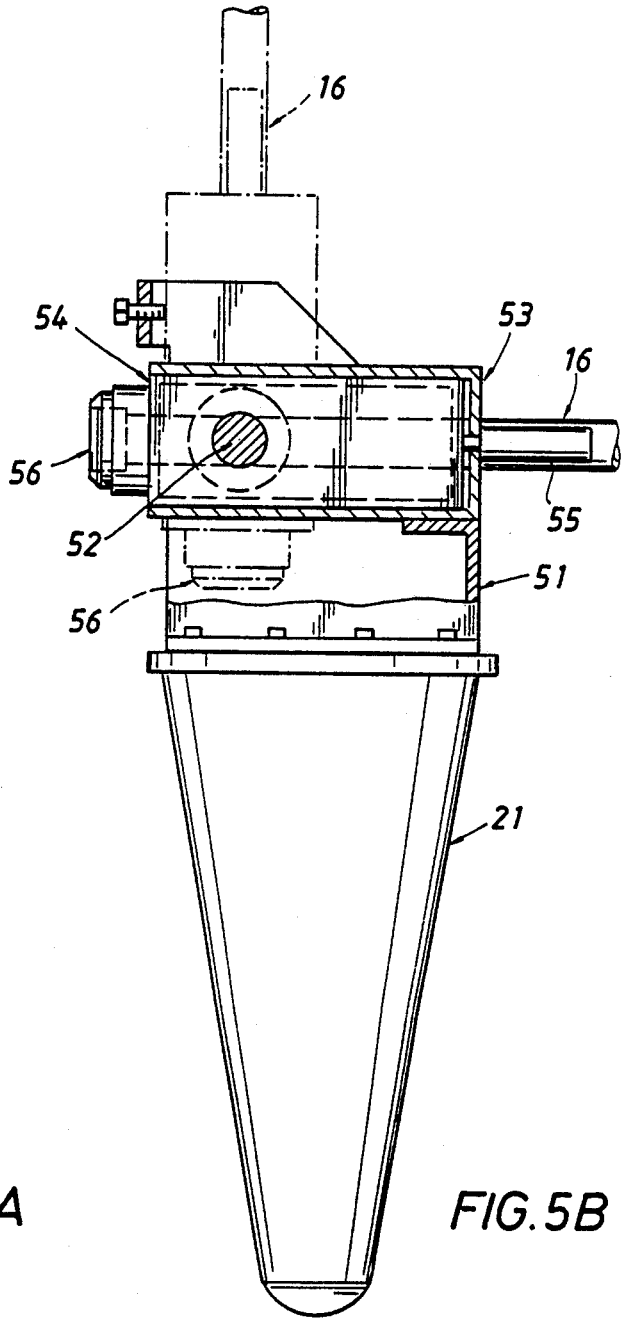
FIG. 5B

SUBSEA WELLHEAD CONNECTIONS

FIELD OF THE INVENTION

This invention relates to connecting subsea flowlines.

BACKGROUND OF THE INVENTION

Techniques to drill and complete oil and gas wells below ocean surfaces have been used since the 1950's. Initially, divers were used to set and align well head equipment, because divers can perform these operations in shallow waters. In recent years, production of oil and gas from fields beyond depths at which divers can function has required development of methods to complete wells without the use of divers. U.S. Pat. No. 3,373,807 discloses such a method to connect an underwater pipeline to a submerged wellhead. This method utilizes guidelines to provide guidance and alignment of connectors to the wellhead. A plurality of guidelines are used to orient a flowline including an end connection. The flowline is lowered vertically from a surface ship, and hinges over to a horizontal position after the flowline end connection comes to rest adjacent to the wellhead. A "christmas tree" which connects the flowline end connection to the wellhead is then lowered along the guidelines.

Methods that utilize guidelines are useful in installing sea floor equipment, but are not preferred in waters deeper than about 3,000 feet. In water deeper than this, the guidelines become exceedingly long, heavy and difficult to work with and failure of the long guidelines can cause serious problems. A method to connect a pipeline or flowline bundle to a deep water well without is disclosed in U.S. Pat. No. 4,541,753. This method utilizes a funnel-shaped receiver attached to the subsea wellhead structure to guide a mating stab connected to the flowline end connection. The flowline is lowered vertically from a surface vessel and the position of the surface vessel is adjusted to result in the stab being lowered into the funnel-shaped receiver. The flowline is pivotably mounted to the stab so that it can be laid down on the ocean floor resulting in the end connection rotating to a position relative to the wellhead that had been predetermined. Another receiver funnel attached to the wellhead could then be utilized to guide a christmas tree with means to connect the wellhead to the flowline connection. This christmas tree can be lowered also without a guideline from a surface vessel in a manner similar to the lowering of the flowline end connection.

The methods of patent '753 can be utilized to connect single pipelines or pipe bundles to subsea facilities in water too deep for either divers or guidelines. However, it is also often useful to connect flowlines between wellheads and a central gathering facility in close proximity to each other. Extending single flowlines from a plurality of satellite wellheads to a central production facility is therefore advantageous. Such satellite well clusters used in shallow waters are disclosed in, for example, *Ocean Industry*, "Saga Plans Subsea Manifold Plus Satellites for Tordis", p. 19, Vol. 26, No. 9, (Nov. 1991). In "Subsea-Completed Wells Account for 18% of Offshore Production", *Offshore*, by Derrick Booth, p 34–36 (Nov. 1991), Petrobras is credited with having developed "guidelineless drilling and completion hardware" although how this is accomplished is not discussed.

It is therefore desirable to have a method to connect subsea flowlines wherein neither guidelines nor divers are required to perform the connections. It is an object of the present invention to provide such a method.

SUMMARY OF THE INVENTION

This and other objects are accomplished by a guidelineless and diverless method to connect at least two subsea flowlines wherein the subsea flowlines comprise (1) a first flowline comprising a first essentially vertical receptacle and a first flowline connection, and (2) a second flowline comprising a second essentially vertical receptacle and a second flowline connection, the method comprising the steps of:

determining the distance between the first flowline connection and the second flowline connection and the orientation of the first flowline connection relative to the second flowline connection;

fabricating a dual-stab jumper assembly comprising a jumper flowline having a first end and a second end wherein the first end and second end can simultaneously align with the first flowline connection and the second flowline connection respectively, the jumper assembly comprising a first and a second pivotable stab wherein the first pivotable stab mates with the first essentially vertical receptacle and the second pivotable stab mates with the second essentially vertical receptacle, and when the stabs are mated to the receptacles, the flowline connections are aligned with the first end and the second end of the jumper flowline;

lowering the jumper assembly to the subsea flowlines wherein the first stab is mated into the first essentially vertical receptacle and the second stab is mated into the second essentially vertical receptacle thereby aligning the first and the second ends of the jumper assembly with the flowline connections; and connecting the first end and the second end of the jumper flowline to the first and the second flowline connections respectively.

In a preferred embodiment, the jumper assembly is lowered vertically to insert one pivotable stab into the first essentially vertical receptacle, and the flowline assembly is then hinged over to an essentially horizontal position with the other pivotable stab inserted in the other essentially vertical receptacle to complete the alignment of the flowline end connections.

The method of the present invention is particularly applicable to the connection of wellheads in the vicinity of a central production manifold to the central production manifold or to connect adjacent wellheads.

The jumper flowline is fabricated to match dimensions between the flowline connections measured, for example, mechanically using a remotely operated vehicle ("ROV") or by acoustic means.

The jumper flowline is preferably a steel pipe due to the lower cost and greater reliability of steel pipe compared to flexible pipes. A flexible pipe could also be utilized and would expand the positional tolerances over which the jumper assembly could be installed. The jumper assembly is preferably about 50 to about 100 feet in length. This length results in ample room to maneuver equipment around the sea floor connections such as wellheads and is short enough that jumper assemblies of this length can be transported and easily handled both aboard surface vessels and in the water as the flowline assembly is lowered to the sea floor.

BRIEF DESCRIPTION OF THE DRAWINGS

FIG. 4 is a schematic of a flowline jumper according to the present invention.

FIGS. 5A and 5B are, respectively, a side and a front view of a stab tool of the present invention.

DETAILED DESCRIPTION OF THE INVENTION

Figure 1:
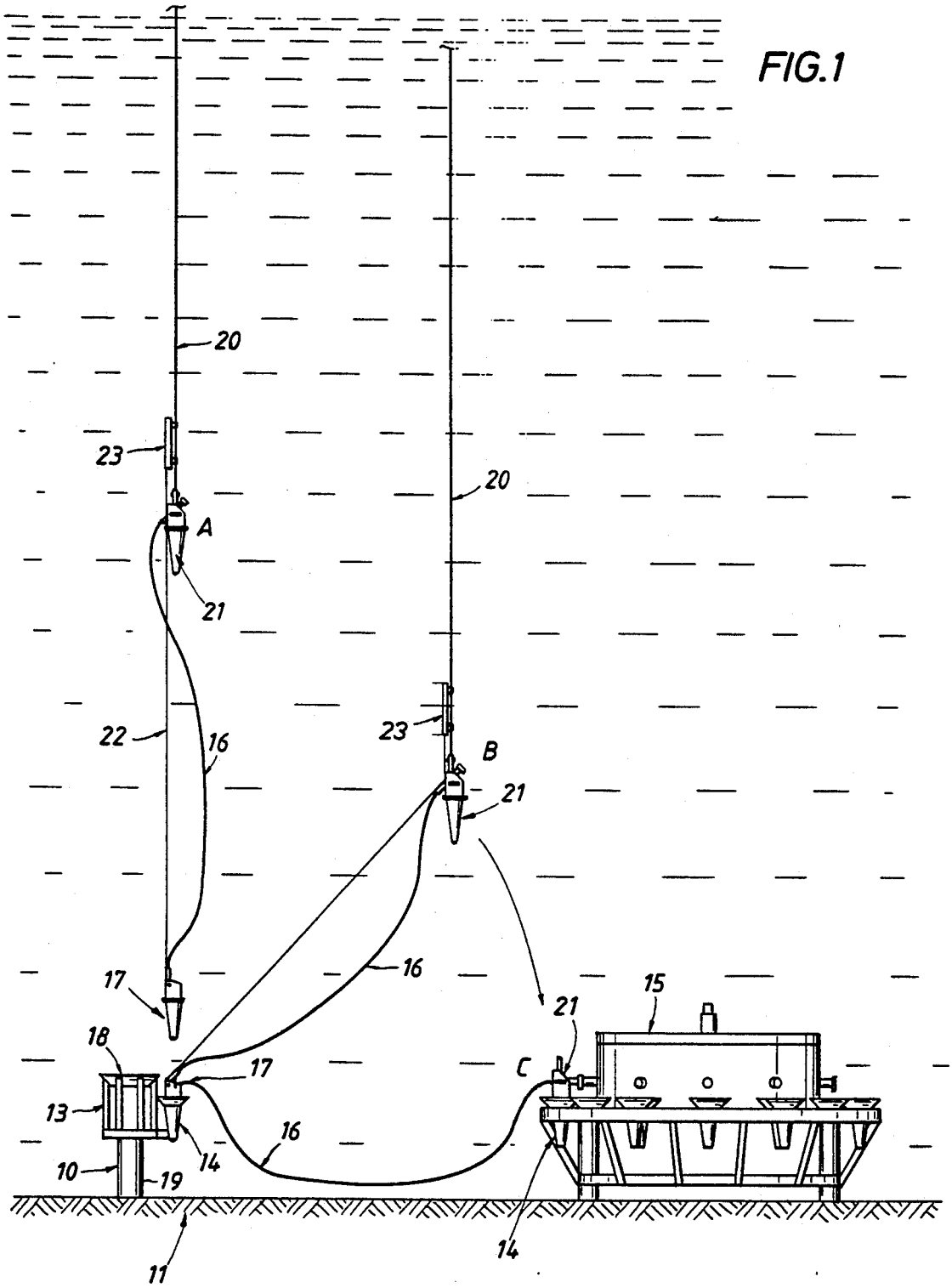
FIG. 1 shows the jumper assembly of the present invention being placed between a wellhead and a central manifold.

Referring now to FIG. 1, a dual-stab jumper assembly 16 is shown in three positions as it is being connected between a wellhead 10 and a central manifold 15, according to the present invention. The jumper assembly could be for connection to any sea floor facilities requiring connection, such as pipeline ends, platform riser ends, wellheads, manifolds or combinations thereof. Wellheads and central manifolds as used in this description are exemplary. The wellhead 10, extends from a sea floor 11. Subsea wells are typically drilled through a surface casing 19. A surface casing is a pipe that has been driven, jetted, or drilled into the seabed and cemented into place. Supports and guides for drilling and completion activities 13 are secured to the top of the surface casing. An essentially vertical funnel receptacle 14, also secured at the top of the surface casing, serves as an alignment receptacle for the stab tool at the wellhead end of the flowline assembly.

The jumper flowline 16 is shown partially installed in positions A, B and C. In position A the jumper flowline 16 is being lowered in an essentially vertical configuration toward the first-end wellhead funnel receptacle 14, while supported by a vertical riser 20 to a surface vessel. A first-end pivotable stab 17 is shown at the lower end of the jumper flowline, and a second-end pivotable stab 21, is shown at the upper end. The first-end pivotable stab 17, the jumper flowline 16, and the second-end pivotable stab 21, comprise the jumper assembly. An optional bowstring cable 22 between the ends of the jumper flowline supports the lower flowline end to prevent the weight of the flowline assembly from plastically deforming the assembly. In position B a first-end pivot stab 17 is shown landed in the essentially vertical funnel receptacle 14 on the wellhead 10, while the flowline has partially hinged over toward the funnel receptacle 14 on the manifold 15. In position C a second-end pivotable stab 21 is shown, with the vertical riser and bowstring removed, landed in the essentially vertical funnel receptacle 14 on the manifold, thus securing the flowline ends into a position wherein each end is aligned with a flowline connection. If necessary, the distance between the stab tools may be adjusted during the stab-in process by means, for example, of a winch (not shown) or a hydraulic cylinder 23 connected in series with the bowstring cable 22, in order to assist the landing of the second-end stab 21 into the funnel receptacle 14 on the manifold 15. Lateral positioning of the second end stab tool may be accomplished by adjusting the position of the surface vessel or by applying torque to the vertical riser 20.

The pivotable stabs are attached to the jumper assembly in a manner that allows the jumper assembly to pivot from the vertical position A down to the horizontal position C with the stabs staying in an essentially vertical position. The hinge pins are shown as offset from the stab centerlines, and the pivoting action is restrained by stops, in a manner to insure that the jumper assembly hinges over in the proper direction. This permits the ends of the jumper assembly to be set sequentially. Sequentially setting the ends allows the flexibility of even a relatively rigid flowline to be used to compensate for a reasonable amount of inaccuracies in the placement of the subsea funnel receptacles and in the dimensions of the fabricated flowline.

The jumper flowline, 16, may be a single pipe, or a multiple pipe bundle containing a main flowline and numerous smaller lines, for example, for hydraulic control and chemical injection lines. When a single flowline is utilized, the jumper flowline may be terminated at each end 18 with a single clamp-type or collet-type mechanical connector. When the flowline comprises a bundle of a plurality of tubes, a more complex connector may be required, the connector having multiple ports and seals. Such connectors for remotely connecting either single subsea flowlines or multiple flowline bundles are available from suppliers such as HydroTech Services, FMC Corporation, or Cooper Oil Tool.

FIG. 1 shows the jumper flowline 16 in a vertical position A, being lowered toward the sea floor from a surface vessel. The position of the first end (lower) stab is preferably adjusted by changing the position of the surface vessel according to method well-known in the art. Surface vessels are typically positioned by adjusting the length of the mooring lines or by dynamic positioning system adjustments. The vertical riser string 20 on which the jumper assembly is lowered may be a cable or a steel pipe such as a drillpipe or other tubular. A drillpipe or tubular riser is preferred because of the greater degree of control that such riser affords over the position and orientation of the flowline assembly being lowered to bottom. For example, the riser may be rotated which in turn rotates the first end stab tool into alignment with the first end funnel receptacle just prior to the initial stab-in. Likewise, a torque can be applied to the tubular riser after the first end stab is landed in the first end funnel thereby flexing, or steering, the jumper assembly. Flexing the jumper assembly in this manner can be useful in aligning the second-end stab into the second end funnel when the jumper assembly would otherwise descend to one side of the second essentially vertical funnel receptacle.

After the first-end stab is seated in the first essentially vertical funnel receptacle 14 on the wellhead, the surface vessel may remain positioned above the first end funnel receptacle 14 or it may be moved to a position above the central manifold 15, depending on the water depth, as the second-end stab 21 is hinged over. The intermediate position B shows the jumper assembly as it is being lowered between the vertical and the horizontal positions. Hinging over the jumper assembly in one continuous motion is preferred to minimize the risk of stretching or otherwise damaging the jumper assembly.

While in this intermediate, partially hinged over position B, the longitudinal position of the second-end stab may be adjusted, if necessary, by taking in or paying out the bowstring cable 22 through the remote operation of an attached winch (not shown) or a hydraulic cylinder 23. Similarly the lateral position of this stab tool may be adjusted, if necessary, by applying torque to the vertical riser from the surface vessel, or by adjusting the position of the surface vessel, prior to landing the second end-stab.

Positions of the subsea funnels in relationship to each other and distances between funnel receptacles may be determined with assistance from a Remote Operated Vehichle (ROV) utilizing either visual information, acoustic information, sonar positioning information, or any combination of these. Visual determination of distance and orientation between funnel receptacles may be obtained by utilizing the ROV to string a measuring tape between funnel receptacles and then visually (by means of the ROV video camera) determining distance between the funnel receptacles. The orientation of the funnel receptacles relative to each other may be determined visually by observing the angle of a measuring tape extended between the funnel receptacles relative to references marked on the upper edges of the receptacles.

Sonar positioning uses a transmitter that sweeps in an arc, and a receiver that detects signals bouncing back from obstacles. The time that the bounced signal is detected indicates both range and, due to the fact that the transmitted signal is swept, direction. By placing a sonar transmitter on one of the receptacles, the distance and direction of the other receptacle may be obtained in this manner. Acoustic positioning requires that a receiver-transmitter be placed on each of the two subsea stab receptacles. When the transmitter on one of the receptacles sends a signal, and when the receiver on the other receptacle receives this signal, that transmitter immediately sends a reply signal. The distance between the two receptacles is then determined by the time lag from the sending of the signal from the initial point and the receiving of the reply signal there. Distances from known fixed points may be determined in order to establish, by triangulation, the position of one funnel receptacle relative to the other. Acoustic means can fix positions of subsea objects to within a few inches with even greater accuracy possible by using high frequency signals.

Position based on visual measurement with a tape is preferred because an ROV equipped with video cameras will usually be required for other steps of the well completion process, and because range and direction, determined by visual means are of sufficient accuracy. Further, the relative orientation of the funnel receptacles is most readily determined by visual information.

Figure 2B:
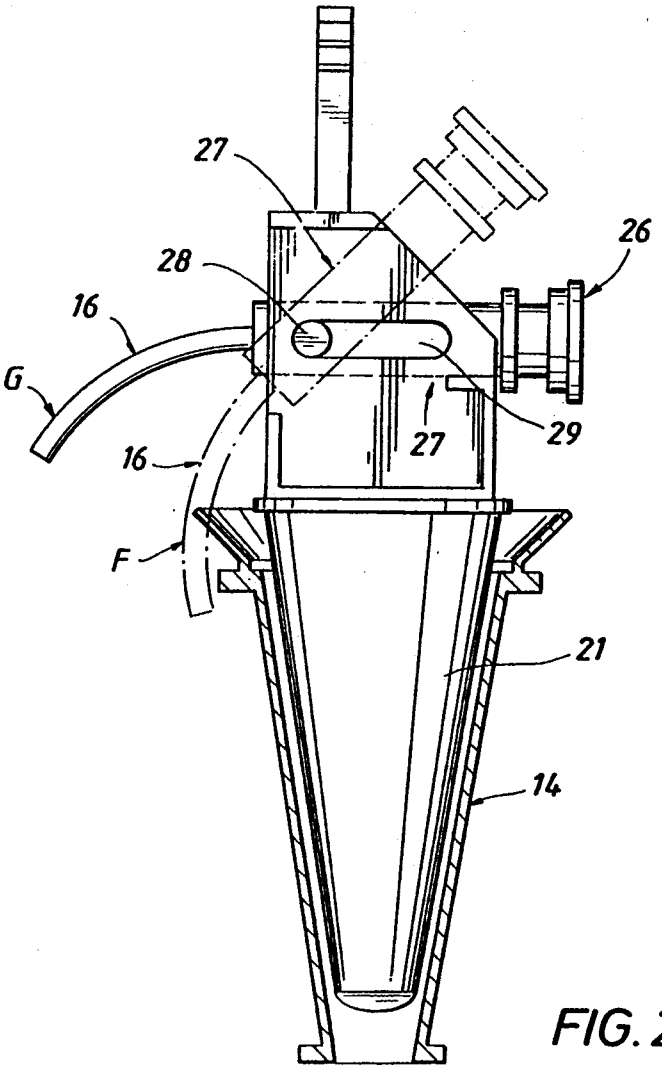
FIGS. 2A and 2B show stab-tools and receptacles acceptable for the of the present invention.
Figure 2A:
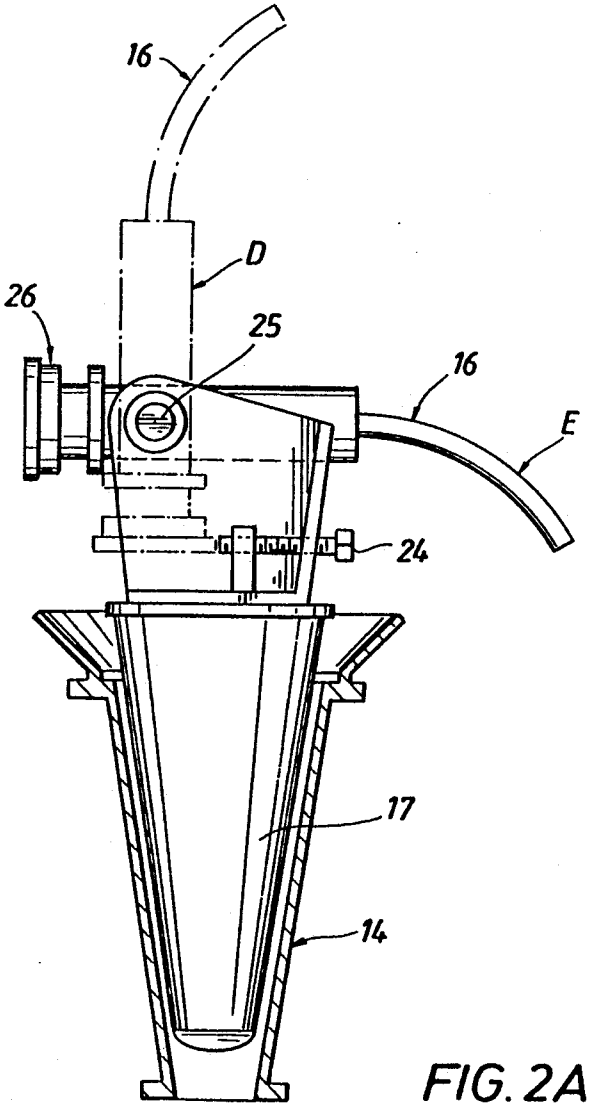

FIGS. 2A and 2B show acceptable first-end and second-end pivotable stab tools for vertically connecting a dual-stab jumper assembly. FIG. 2A shows a profile view of a preferred configuration of a first-end pivotable stab tool almost landed in a mating receptacle. The stab tool 17 and receptacle 14 have tapered profiles and square cross-sections throughout, which are preferred means of providing precise alignment control. The receptacle is stationary and is positioned in relationship to a flowline end connection so that when laid down, the flowline jumper connection hub 26, is aligned with the flowline end connection. The flowline 16 pivots about hinge pins 25, and is shown in dashed lines in the initial vertical-up position D, that occurs as the flowline and stab tool are lowered, and in solid lines in the final horizontal (hinged over) position E. The end of the flowline can be fitted with, for example, either a connection hub or a mechanical connector 26. The connection hub permits a clamp-type connection. A mechanical or hydraulic connector may be a collet-type connection such as those known in the art. The flowline jumper hub or connector 26 may include means to telescope forward as necessary to mate with the flowline end connection or the flowline end connection may be one that strokes out to the flowline jumper hub or connector.

FIG. 2B shows a preferred configuration of a second-end pivotable stab tool almost landed in a mating receptacle. As before, the stab tool 21 and the receptacle 14 have linearly tapered profiles and square cross-sections for precise alignment control. The jumper flowline 16 pivots about hinge pins 28, and is shown in dashed lines in the initial vertical down position F, that occurs as the jumper assembly and the stab tool are lowered to bottom, and in solid lines in the final horizontal (hinged-over) position G. The second-end pivotable stab is shown with an optional elongated slot 29 permitting the flowline jumper hub or connector 26 to telescope forward as necessary to mate With the flowline end connection. The elongated slot 29, or other means of allowing rotation and horizontal translation of the flowline jumper hub or connector hub 26, may be incorporated in either end of the jumper assembly, or both ends.

The hinge pin is preferably offset from the vertical center of gravity of the stab in the direction opposite to the direction which the jumper assembly is to be laid down. An adjustable stop, depicted in FIG. 2A by the screw 24, permits the stab tool axis to hang vertically while the weight of the stab tool applies a bending moment to the jumper assembly tending to hinge it over in the proper direction. After such a stab is inserted in a funnel receptacle by a vertical descent, the center of gravity of the flowline assembly will be offset from the first stab in the direction which the jumper assembly is to be laid down. This insures that the hingeover occurs in the direction of the second end connection. Scale model tests have shown that offsetting the hinge pin in the direction opposite to that which the jumper assembly is to be laid down eliminates any tendency for the jumper assembly to lay down in the wrong direction.

FIGS. 5A and 5B show an alternative pivotable stab tool. A first-end stab is shown, but a similar configuration could also be used on the second end. In the embodiment of FIGS. 5A and 5B, the jumper flowline can be telescoped by hydraulic actuators fixed on the stab tool. The jumper flowline can thus be telescoped to connect with a mating connection on the wellhead or central manifold. Referring now to FIG. 5A and 5B, a stab 21 is pivotably connected to the jumper flowline 16 by hinge pins 52. The hinge pins are secured to a bracket 51 and the bracket is connected to the stab tool. The hinge pins are secured to an outer box 53 that forms a housing in which an inner box 54 may move along the central axis of the outer box. The jumper flowline 16 is affixed to the inner box. The inner box 54 can be telescoped from the outer box by hydraulic actuators 55 upon the hydraulic actuators receiving hydraulic fluid pressure, for example, from a pump on the ROV or from hydraulic tubing clamped onto the riser 20 from the surface. Providing stab tools with telescoping jumper flowline end connection results in the moving parts being on the jumper assembly rather than on the wellhead or central manifold. Removal of the actuators for repair or replacement is therefore facilitated by the configuration of FIG. 5A and 5B, because of the relative ease of disconnecting and recovering the jumper assembly to the surface.

The jumper flowline ends in FIGS. 1, 2 and 4 are shown as horizontal, but this is not a critical feature. If the flowline end connections are to be lowered to the subsea facilities after the jumper flowline is set in place, the flowline end connections could be placed vertically upward, as in FIG. 3A and the end connections lowered on top of the jumper flowline ends. Conversely, if the jumper assembly is put in place after the flowline end connections are put in place, the ends of the jumper flowlines could extend vertically downward. A horizontal position such as that shown in FIGS. 2A and 2B is preferred because it can provide an option to remove either the jumper assembly or the facilities associated with the flowline end connections without having to remove both.

The funnel receptacles and stabs may be of any convenient cross-sectional shapes, so long as they mate. Square cross-sections are preferred because they are robust, easier to fabricate, and provide accurate alignment of the flowline ends to the flowline connections. Square stabs must be placed in the receptacles to within about 30° of the correct alignment in order for the stab tool to landed properly. The stab placed within this tolerance will typically settle squarely within the receptacle. The orientation of the stab tool prior to stabbing may be adjusted from the surface vessel by, for example, rotating the riser from which the flowline is suspended based on video information transmitted from an ROV.

Figure 3A:
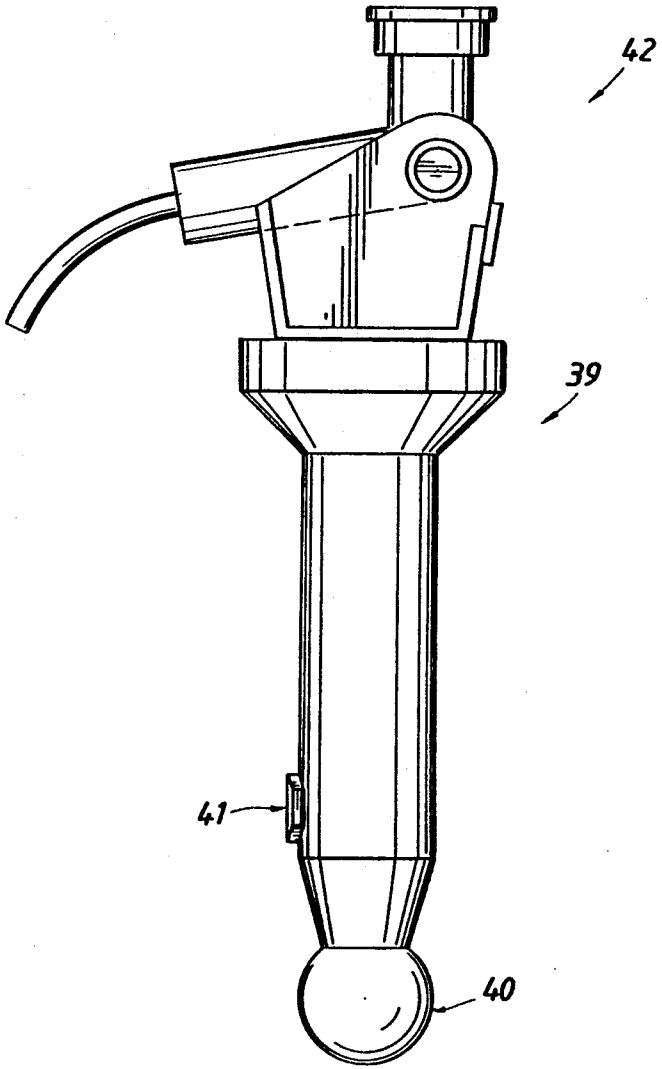
FIGS. 3A and 3B show alternative stab-tools and receptacles acceptable for the first end connections of the present invention.
Figure 3B:
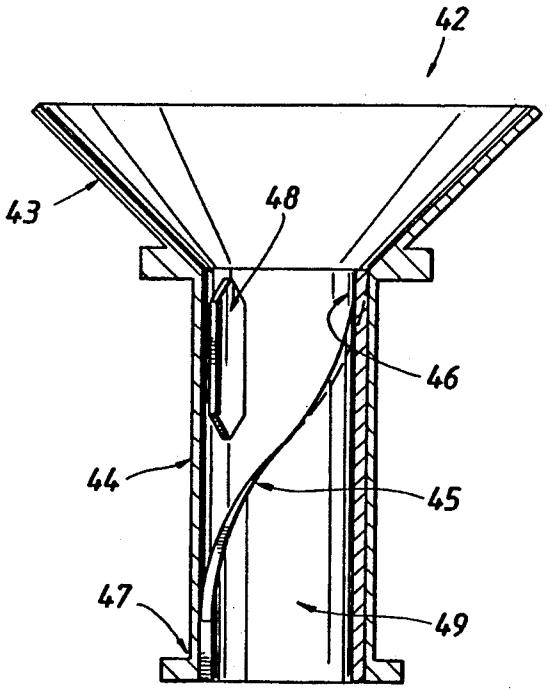

If a stab and funnel receptacle having a round cross-section is used, a configuration such as that shown in FIG. 3A and 3B is preferred. Referring to FIG. 3A, a cylindrical stab tool 39, having a round cross section, is shown with an alignment ball 40 at the lower end, and a male peg 41 protruding from the side of the stab. FIG. 3B shows a round funnel receptacle 42 having an internal spiral ledge 45 and a spacer plate 48. This funnel receptacle is suitable for use with the round stab tool 39. Upon being lowered into the receptacle 42, the ball 40 and the tapered portion of the stab tool 39, provide alignment of the axes of the stab tool and receptacle. As the stab descends into the funnel receptacle, the peg 41 on the stab in combination with the spiral ledge 45 on the funnel receptacle provide rotational alignment of the stab tool about the vertical axis.

The funnel of this configuration consists of a guidance portion 43 and an alignment portion 44. Along the inner diameter of the alignment portion is a triangular plate 49 rolled to fit the contour of the inside diameter of the alignment section. The top edge of the triangular plate forms the spiral ledge 45. The apex of the triangular plate 46 is opposite to the final alignment point 47 for the peg 41. Regardless of the orientation of the peg 41, and indeed the orientation of the stab 39 itself, as the stab is lowered into the receptacle, the peg will hit the triangular sloping portion of the plate and will align itself to the final alignment point when the stab is fully inserted. Other mating stabs and receptacles could also be designed and could function acceptably in the practice of the present invention.

The flowlines of the present invention may be flexible lines such as "COFLEXIP" pipe or a pre-shaped steel pipe design as shown in FIG. 4. Such flexible lines are typically fabricated as a composite of steel and polymer materials. Fabrication and installation of flexible lines to connect at each end with a wellhead and a central manifold may be simpler than fabrication of steel pipes to match connections at both ends. Steel pipes are preferred as the flowlines of the present invention due to lower costs of steel pipes and because elastomers used to construct flexible pipe may degrade over time. Steel pipes are also preferred because flexible lines are presently only available in a limited variety of sizes and pressure ratings.

Figure 6A:
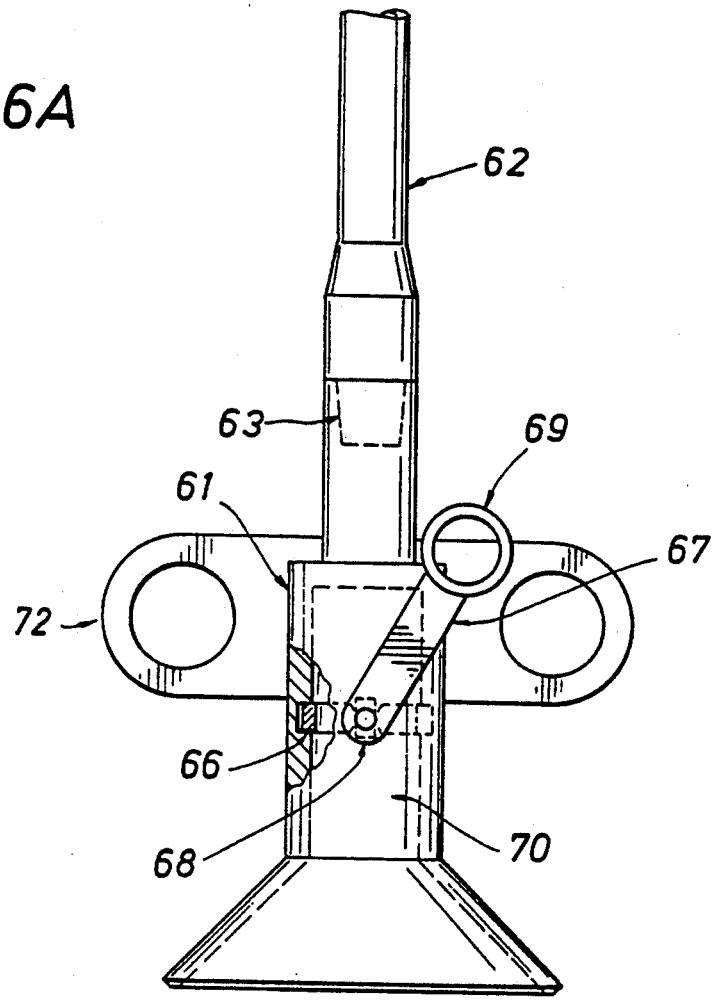
FIGS. 6A and 6B are, respectively, profiles of a riser release tool and a riser release tool interface post.
Figure 6B:
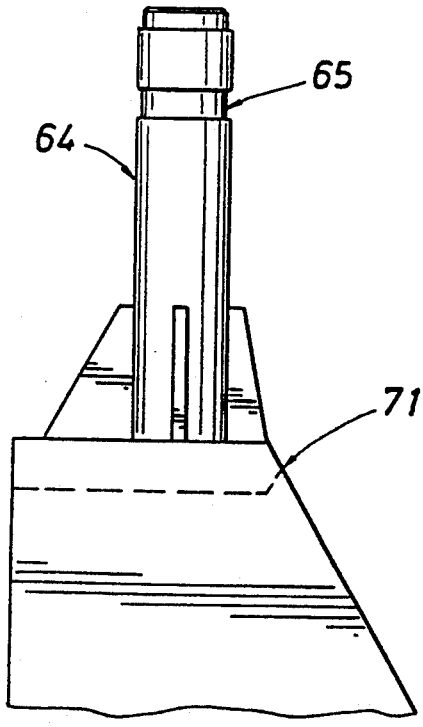

FIG. 6A shows a riser release tool that is acceptable in the practice of the present invention. FIG. 6B shows a riser release tool interface post that mates with the riser release tool of FIG. 6A. The riser release tool can function to connect a riser, 62, to the jumper assembly, 71, such that the riser may be released, and subsequently reattached to recover the flowline assembly, or other recoverable subsea equipment equipped with a mating release tool interface post. The riser release tool, 61, can be attached to the riser, 62, by a threaded connection 63, such as a typical drilling tool joint. The riser release tool may be fitted with running tool fittings, 72, to enable conventional handling aboard a surface vessel such as a conventional drilling ship. The riser release tool comprises a cavity, 70, for mating with the riser release tool interface post, 64. A locking ring, 66, within the riser release tool, mates to a locking notch 65 on the riser release tool interface post 64 when the locking ring is in a relaxed position. A riser release lever, 67, operates a cam, 68, which, when rotated, spreads the locking ring, 66, to allow the riser release tool to be removed from the riser release tool interface post, 64. The riser release lever, 67, could be fitted with a ring, 69, to enable easier operation of the riser release lever by means such as an ROV manipulator arm.

The stabs are shown in the figures as fitting inside of the receptacles. This is the preferred arrangement but the stabs could alternatively stab externally around stationary funnels. In a configuration where the stabs are external, the stabs could resemble hollow funnels with the large openings at the bottom, and the stationary internal receptacles would also be inverted with the smallest cross-section at the top.

A flowline of about 3.5 to 6.0 inch outside diameter and about 0.5 to 0.75 inch wall thickness will have sufficient flexibility to connect subsea wellheads to central manifold facilities if the flowline is of a configuration similar to that illustrated in FIG. 4, with each end at least 15 feet above the middle, and at least a 50 foot distance between the receptacles. To insure successful stab connections, for a flowline of about these dimensions, the distance between the receptacles must be measured to within about 1 foot accuracy, and the orientation of the receptacles must be within about 10 degrees from pointing directly toward each other, and this orientation of the receptacles must be measured to within an accuracy of 5 degrees. If the dimensions between the funnels are outside of this range, a steel pipe flowline may nevertheless be used, but the design may require alteration, such as rotating the joints between the bends before welding, varying the bend radii or angles, or inclusion of additional bends to configure the jumper flowline to fit more accurately between the existing receptacle funnels.

FIG. 4 shows a jumper flowline that would have sufficient flexibility to be utilized in the practice of the present invention. The jumper flowline, beginning essentially horizontally at a first end, bends downward to form an arc of an angle of about 65 degrees over a radius $R_2$ of about six feet (a first over bend), then bends at a larger radius $R_1$ of about 20 feet in a direction opposite to the first bend over an arc of about 65 degrees (a first sag bend). The flowline thereafter extends along a straight line about parallel to the orientation of the first end of the flowline, through a length $X_0$ of between about 0 and about 50 feet, depending on the total horizontal distance between the flowlines to be connected. The pipe then bends upward through an angle also about 65 degrees, at a radius of $R_1$ of about 20 feet (a second sag bend) and then bends down with radius $R_2$ of about 6 feet (a second over bend). It is preferred that the second end be angled about 5° downward from the parallel to the first end, in this manner, as the natural flexing of the pipe due to its weight will tend to bring the end of the flowline toward parallel with the first end. These dimensions will provide sufficient flexibility in a flowline of about 3.5 to about 6.0 inch outside diameter.

When a steel jumper flowline as described above is fabricated in a U-shape with horizontal ends having two 65 degree sag bends, two over bends of approximately 60–80 degrees each, as appropriate, and length between ends of between fifty and one hundred feet, and vertical portions of about fifteen feet, longitudinal end forces of only about 2000 to about 5000 pounds will displace one end about two to about four feet longitudinally when the other end is anchored. The flexibility of the jumper flowline is even greater laterally than longitudinally, requiring less than 500 pounds to deflect a free end laterally by 2–4 feet. This elastic flexibility permits fabrication of steel flowlines to tolerances that can reasonably be measured on the sea floor, which can then be installed with a high probability of success.

Embodiments described herein are illustrative, and the following claims define the scope of the present invention.

We claim:

1. A guidelineless and diverless method to connect at least two subsea flowlines wherein the subsea flowlines comprise (1) a first flowline comprising a first essentially vertical receptacle and a first flowline connection and (2) a second flowline comprising a second essentially vertical receptacle, and a second flowline connection, the method comprising the steps of:

determining the distance between the first flowline connection and the second flowline connection and the orientation of the first flowline connection relative to the second flowline connection;

fabricating a dual-stab jumper assembly comprising jumper flowline having a first end and a second end wherein the first end and the second end can simultaneously align with the first flowline connection and the second flowline connection respectively, the jumper assembly comprising a first and a second pivotable stab wherein the first pivotable stab mates with the first essentially vertical receptacle and the second pivotable stab mates with the second essentially vertical receptacle, and when the stabs are mated to the receptacles, the flowline connections are aligned with the first end and the second end of the jumper flowline;

lowering the jumper assembly to the subsea flowlines wherein the first stab is mated into the first essentially vertical receptacle and the second stab is mated into the second essentially vertical receptacle thereby aligning the first and the second ends of the jumper assembly with the flowline connections; and connecting the first end and the second end of the jumper flowline to the first and the second flowline connections respectively.

2. The method of claim 1 wherein the jumper assembly is lowered in a vertical position from a surface vessel, with the first stab below the second stab, until the first stab is inserted in the first essentially vertical receptacle.

3. The method of claim 2 wherein the first and second stabs are inserted in the respective first and second receptacles while lowering the flowline assembly in one continuous downward motion.

4. The method of claim 2 wherein the pivotable stabs comprise offset hinge pins and hinge stops.

5. The method of claim 2 wherein the jumper assembly is protected from plastic bending deformations when in the vertical position by a bowstring cable supporting the lower end of the jumper assembly.

6. The method of claim 5 wherein the second stab's longitudinal position is adjusted by paying out or taking in the bowstring cable.

7. The method of claim 2 wherein at least one of the stabs and its corresponding essentially vertical receptacle is a linearly tapered funnel with a square cross section.

8. The method of claim 2 wherein at least one of the stabs and its corresponding essentially vertical receptacle is cylindrical with a peg on the stab and an internal spiral ledge in the receptacle.

9. The method of claim 1 wherein the jumper assembly is lowered from the surface vessel by means of a tubular riser.

10. The method of claim 9 wherein the lateral position of the second stab is adjusted by applying torque to the tubular riser.

11. The method of claim 1 wherein the jumper assembly comprises at least one composite flexible pipe.

12. The method of claim 1 wherein the jumper flowline comprises at least o e steel pipe.

13. The method of claim 12 wherein the flowline comprises at least one steel pipe of about 3.5 inch to about 6 inch external diameter and about 0.50 to about 0.75 inch wall thickness.

14. The method of claim 13 wherein the jumper assembly further comprises at least one separate line for control of the wellhead.

15. The method of claim 13 wherein the flowline further comprises at least one separate line for supplying chemical injections to the wellhead.

16. The method of claim 13 wherein the subsea flowlines are separated by between about 50 feet and about 100 feet.

17. The method of claim 13 wherein the flowline is pre-formed into a shape consisting of two approximately 65-degree overbends and two approximately 65-degree sagbends.

18. The method of claim 1 wherein the distance and bearings between the subsea flowlines are determined mechanically.

19. The method of claim 1 wherein the distance and bearings between the subsea flowlines are determined acoustically.

20. The method of claim 1 wherein the distance and bearings between the wellhead and the central manifold are determined by sonar means.

21. The method of claim 1 wherein the first and second jumper flowline ends are connected to the first and second flowline connections by remotely operated clamp-type or collet-type mechanical connectors.

22. The method of claim 21 wherein the first pivotable stab includes a remotely operated mechanism to translate the jumper flowline end longitudinally a sufficient distance to mate with the first flowline connection.

23. The method of claim 21 wherein the second pivotable stab includes a remotely operated mechanism to translate the jumper flowline end longitudinally a sufficient distance to mate with the second flowline connection.

* * * * *